US009048559B2

(12) United States Patent
Huang

(10) Patent No.: US 9,048,559 B2
(45) Date of Patent: Jun. 2, 2015

(54) POWER OUTLET WITH JACK SAFETY SHIELD DEVICE

(76) Inventor: Huadao Huang, Yueqing (CN)

( * ) Notice: Subject to any disclaimer, the term of this patent is extended or adjusted under 35 U.S.C. 154(b) by 595 days.

(21) Appl. No.: 13/467,018

(22) Filed: May 8, 2012

(65) Prior Publication Data

US 2012/0287572 A1 Nov. 15, 2012

(30) Foreign Application Priority Data

May 12, 2011 (CN) ..... 2011 1 0122297

(51) Int. Cl.
*H01R 13/44* (2006.01)
*H01R 13/453* (2006.01)
*H01R 25/00* (2006.01)

(52) U.S. Cl.
CPC ..... *H01R 13/4534* (2013.01); *H01R 25/006* (2013.01)

(58) Field of Classification Search
CPC ..... H01R 13/4534; H01R 13/447
USPC ..... 439/137, 145
See application file for complete search history.

(56) References Cited

U.S. PATENT DOCUMENTS

| | | | | |
|---|---|---|---|---|
| 4,271,337 | A | 6/1981 | Barkas | |
| 4,379,607 | A | 4/1983 | Bowden | |
| 4,544,219 | A | 10/1985 | Barkas | |
| 4,729,741 | A * | 3/1988 | Peng | 439/137 |
| 4,822,290 | A | 4/1989 | Cauley et al. | |
| 4,867,694 | A | 9/1989 | Short | |
| 5,006,075 | A | 4/1991 | Bowden, Jr. | |
| 5,020,997 | A | 6/1991 | Calderara et al. | |
| 5,915,981 | A | 6/1999 | Mehta | |
| 6,056,564 | A | 5/2000 | Huang | |
| 6,086,391 | A | 7/2000 | Chiu | |
| 6,217,353 | B1 | 4/2001 | Yu-Tse | |
| 6,238,224 | B1 | 5/2001 | Shao | |
| 6,422,880 | B1 | 7/2002 | Chiu | |
| 6,537,088 | B2 | 3/2003 | Huang | |
| 6,537,089 | B1 | 3/2003 | Montague | |
| 6,555,771 | B2 | 4/2003 | Shao | |
| 6,580,344 | B2 | 6/2003 | Li | |
| 6,776,630 | B1 | 8/2004 | Huang | |
| 6,786,745 | B1 | 9/2004 | Huang | |
| 6,893,275 | B2 | 5/2005 | Ng et al. | |
| 6,963,260 | B2 | 11/2005 | Germain et al. | |
| 6,998,945 | B2 | 2/2006 | Huang et al. | |
| 7,019,952 | B2 | 3/2006 | Huang et al. | |
| 7,179,992 | B1 | 2/2007 | Packard et al. | |
| 7,195,500 | B2 | 3/2007 | Huang et al. | |
| 7,265,956 | B2 | 9/2007 | Huang | |

(Continued)

FOREIGN PATENT DOCUMENTS

| | | | |
|---|---|---|---|
| CN | 2476889 | Y | 2/2002 |
| CN | 201490423 | U | 5/2010 |

(Continued)

*Primary Examiner* — Phuong Dinh
(74) *Attorney, Agent, or Firm* — Mei & Mark LLP

(57) ABSTRACT

An electrical receptacle with a baffle latching mechanism can prevent an electroshock accident by keeping the baffle and baffle latching mechanism from moving. A baffle latching mechanism for an electrical receptacle, comprises a rectilinear baffle latch comprising a first side perpendicular to a second side, a positioning groove between a first end and a second end of the first side, a platform at the bottom of the positioning groove, and a positioning convex pin projecting from the second side of the baffle latch.

23 Claims, 16 Drawing Sheets

(56) References Cited

U.S. PATENT DOCUMENTS

| | | | | |
|---|---|---|---|---|
| 7,289,306 | B2 | 10/2007 | Huang | |
| 7,295,415 | B2 | 11/2007 | Huang et al. | |
| 7,315,227 | B2 | 1/2008 | Huang et al. | |
| 7,317,600 | B2 | 1/2008 | Huang et al. | |
| 7,411,766 | B1 | 8/2008 | Huang et al. | |
| 7,455,538 | B2 | 11/2008 | Germain | |
| 7,510,412 | B1 | 3/2009 | Valentin | |
| 7,538,993 | B2 | 5/2009 | Huang et al. | |
| 7,556,513 | B2 | 7/2009 | Ng et al. | |
| 7,576,959 | B2 | 8/2009 | Huang et al. | |
| 7,588,447 | B1 | 9/2009 | Ni | |
| 7,633,726 | B2 | 12/2009 | Huang et al. | |
| 7,645,148 | B2 | 1/2010 | Carbone et al. | |
| 7,645,149 | B2 | 1/2010 | Carbone et al. | |
| 7,651,347 | B2 | 1/2010 | Germain et al. | |
| 7,651,348 | B2 | 1/2010 | Huang et al. | |
| 7,775,812 | B2 * | 8/2010 | Nakazawa et al. | 439/137 |
| 7,820,909 | B2 | 10/2010 | Castaldo et al. | |
| 7,833,030 | B1 | 11/2010 | Huang | |
| 7,859,368 | B2 | 12/2010 | Huang et al. | |
| 7,883,346 | B2 | 2/2011 | Huang | |
| 7,887,346 | B1 | 2/2011 | Huang | |
| 7,914,307 | B1 | 3/2011 | Yang | |
| 7,934,935 | B1 | 5/2011 | Gao | |
| 7,942,681 | B2 | 5/2011 | Ni | |
| 7,985,085 | B2 | 7/2011 | Gao | |
| 8,007,296 | B2 | 8/2011 | Chen et al. | |
| 8,044,299 | B2 | 10/2011 | Weeks | |
| 8,100,705 | B2 * | 1/2012 | Chen et al. | 439/137 |
| 8,147,260 | B2 | 4/2012 | Huang | |
| 8,187,011 | B1 | 5/2012 | Baldwin et al. | |
| 8,187,012 | B1 | 5/2012 | Baldwin et al. | |
| 8,193,445 | B2 | 6/2012 | Li | |
| 8,233,251 | B2 | 7/2012 | Huang et al. | |
| 8,242,362 | B2 | 8/2012 | Castaldo et al. | |
| 8,297,990 | B2 | 10/2012 | Huang | |
| 8,297,999 | B2 | 10/2012 | Asakura et al. | |
| 8,300,368 | B2 | 10/2012 | Huang et al. | |
| 8,366,463 | B2 | 2/2013 | Zhang et al. | |
| 8,382,497 | B2 | 2/2013 | Huang | |
| 8,472,155 | B2 | 6/2013 | Huang | |
| 8,550,829 | B2 | 10/2013 | Huang | |
| 8,736,279 | B2 | 5/2014 | Huang | |
| 2003/0017731 | A1 | 1/2003 | Huang | |
| 2004/0027740 | A1 | 2/2004 | Huang et al. | |
| 2006/0193092 | A1 | 8/2006 | Huang et al. | |
| 2006/0238933 | A1 | 10/2006 | Huang et al. | |
| 2006/0274463 | A1 | 12/2006 | Huang et al. | |
| 2006/0279886 | A1 | 12/2006 | Huang et al. | |
| 2007/0014068 | A1 | 1/2007 | Huang et al. | |
| 2007/0041134 | A1 | 2/2007 | Huang et al. | |
| 2007/0049077 | A1 | 3/2007 | Germain | |
| 2007/0076337 | A1 | 4/2007 | Huang | |
| 2007/0086127 | A1 | 4/2007 | Huang | |
| 2007/0114053 | A1 | 5/2007 | Castaldo et al. | |
| 2007/0211397 | A1 | 9/2007 | Sokolow et al. | |
| 2008/0094765 | A1 | 4/2008 | Huang et al. | |
| 2008/0170341 | A1 | 7/2008 | Huang et al. | |
| 2008/0192393 | A1 | 8/2008 | Huang et al. | |
| 2009/0086389 | A1 | 4/2009 | Huang et al. | |
| 2009/0086390 | A1 | 4/2009 | Huang | |
| 2009/0091869 | A1 | 4/2009 | Huang et al. | |
| 2009/0161271 | A1 | 6/2009 | Huang et al. | |
| 2009/0227130 | A1 | 9/2009 | Carbone et al. | |
| 2009/0236115 | A1 | 9/2009 | Li | |
| 2009/0311892 | A1 | 12/2009 | Weeks | |
| 2010/0041259 | A1 | 2/2010 | Ni | |
| 2010/0073178 | A1 | 3/2010 | Huang et al. | |
| 2010/0159722 | A1 | 6/2010 | Chen | |
| 2010/0317207 | A1 | 12/2010 | Huang | |
| 2010/0317208 | A1 | 12/2010 | Chen et al. | |
| 2010/0317209 | A1 | 12/2010 | Huang | |
| 2011/0028011 | A1 | 2/2011 | Castaldo et al. | |
| 2011/0092085 | A1 | 4/2011 | Gao | |
| 2011/0092086 | A1 * | 4/2011 | Gao | 439/137 |
| 2011/0104918 | A1 | 5/2011 | Chen et al. | |
| 2011/0136358 | A1 | 6/2011 | Zhang et al. | |
| 2011/0211283 | A1 | 9/2011 | Huang et al. | |
| 2011/0273803 | A1 | 11/2011 | Huang | |
| 2011/0273813 | A1 | 11/2011 | Huang | |
| 2012/0081819 | A1 | 4/2012 | Huang | |
| 2012/0083142 | A1 | 4/2012 | Huang | |
| 2012/0083143 | A1 | 4/2012 | Jiang et al. | |
| 2012/0149221 | A1 | 6/2012 | Huang | |
| 2012/0170159 | A1 | 7/2012 | Huang | |
| 2012/0187958 | A1 | 7/2012 | Huang | |
| 2012/0287537 | A1 | 11/2012 | Huang | |
| 2012/0287572 | A1 | 11/2012 | Huang | |
| 2012/0320485 | A1 | 12/2012 | Huang | |
| 2013/0171847 | A1 | 7/2013 | Huang et al. | |

FOREIGN PATENT DOCUMENTS

| | | |
|---|---|---|
| CN | 200920167808.3 | 5/2010 |
| CN | 201536176 U | 7/2010 |
| CN | 200920223089.2 | 7/2010 |
| CN | 102270788 A | 12/2011 |

* cited by examiner

POWER OUTLET WITH JACK SAFETY SHIELD DEVICE

This application claims the benefit of priority of Chinese patent application 201110122297.5 filed May 12, 2011, the content of which is incorporated herein by reference in its entirety.

TECHNICAL FIELD

The present disclosure relates generally to electrical receptacles. More specifically, the disclosure relates to an electrical receptacle with a baffle latching mechanism.

BACKGROUND

The existing technology includes two types of electrical receptacles. In one type, the left and right sockets are both I-shaped. In the other type, the left socket is I-shaped and the right socket is T-shaped. The electrical receptacle with a socket baffle device normally includes an enclosure, a reset button with extension arm and a jack guard baffle mechanism. An example for a dual-I-shaped safety baffle device is the baffle device publicized in the Chinese utility model patent with Patent No. of 200920223089.2. It includes a left baffle, right baffle, spring, pedestal connected securely with the middle-level support, etc. An example for a left-I & right-T-shaped safety baffle devices is the baffle device publicized in the Chinese utility model patent with Patent No. of 200920167808.3. It includes a first spring used for reset of the left and right baffles, the small baffle used for blocking the T-shaped hole, a second spring and reset mechanism used for reset of the small baffle, and a pedestal connected securely with the middle-level support. When a plug is inserted into the baffles, the left and right baffles are exposed, exposing the guide plug bush below them. When the plug is pulled out, the baffle unit covers the guide plug bush under the function of the reset spring. The baffles must cooperate with the latching mechanism to realize the function of covering the conductive plug bush. The problem to be resolved by this disclosure is to provide an electrical receptacle with a baffle latching mechanism, which is simple in structure and has excellent action reliability.

SUMMARY

The inventor provides an electrical receptacle with a baffle latching mechanism, which is simple in structure and has excellent action reliability.

A baffle latching mechanism for an electrical receptacle, comprises a rectilinear baffle latch comprising a first side perpendicular to a second side, a positioning groove between a first end and a second end of the first side, a platform at the bottom of the positioning groove, and a positioning convex pin projecting from the second side of the baffle latch.

A safety mechanism for an electrical receptacle, comprises a rectilinear baffle latch comprising a first side perpendicular to a second side, a positioning groove between a first end and a second end of the first side, a platform at the bottom of the positioning groove, and a positioning convex pin projecting from the second side of the baffle latch. A baffle comprises an end face and a groove in the end face. The positioning convex pin projects against the end face of the baffle when the baffle latching mechanism is in a locked condition. The positioning convex pin projects in to the groove of the baffle when the baffle latching mechanism is in an unlocked condition.

An electrical receptacle comprises a reset button, a reset extension arm attached to the reset button, an enclosure, and a baffle comprising an outer wall and a positioning groove in the outer wall. A baffle latch comprises a positioning convex pin and an elastic element. The elastic element abuts the baffle latch and one of the enclosure or the reset extension arm, and the elastic element drives the baffle latch between a locked condition and an unlocked condition. The reset button is configured to move between a tripped position and a reset position. When the reset button is in the tripped position, the positioning convex pin projects against the outer wall of the baffle and the baffle latch is in the locked condition. When the reset button is in the reset position, the positioning convex pin projects in to the groove of the baffle and the baffle latch is in the unlocked condition.

The advantage of this electrical receptacle is the prevention of an electroshock accident when there is a problem with the wiring or in reverse wiring conditions. The electrical receptacle can keep the mounting baffle and latching mechanism from moving, thereby preventing an electroshock accident caused by an abnormal or mistaken plug-in and ensuring safety in use. The latching mechanism provides a buffer space for the reset button extension arm, and can effectively prevent the reset button from jumping up and damaging the baffle latch when the plug is not pulled out. The latching mechanism operates stably and acts reliably. The structure of this baffle latch is simple. Only one type of molded part is needed for both the left side and the right side, minimizing the quantity of parts, reducing the cost for mold making, and facilitating warehouse storage and installation.

Additional objects and advantages of the electrical receptacle will be set forth in part in the description which follows, and in part will be obvious from the description, or may be learned through practice. The objects and advantages of the electrical receptacle will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DETAILED DESCRIPTION

Reference will now be made in detail to the present exemplary embodiments, examples of which are illustrated in the accompanying drawings. Wherever possible, the same reference numbers will be used throughout the drawings to refer to the same or like parts.

Example 1

Figure 1:
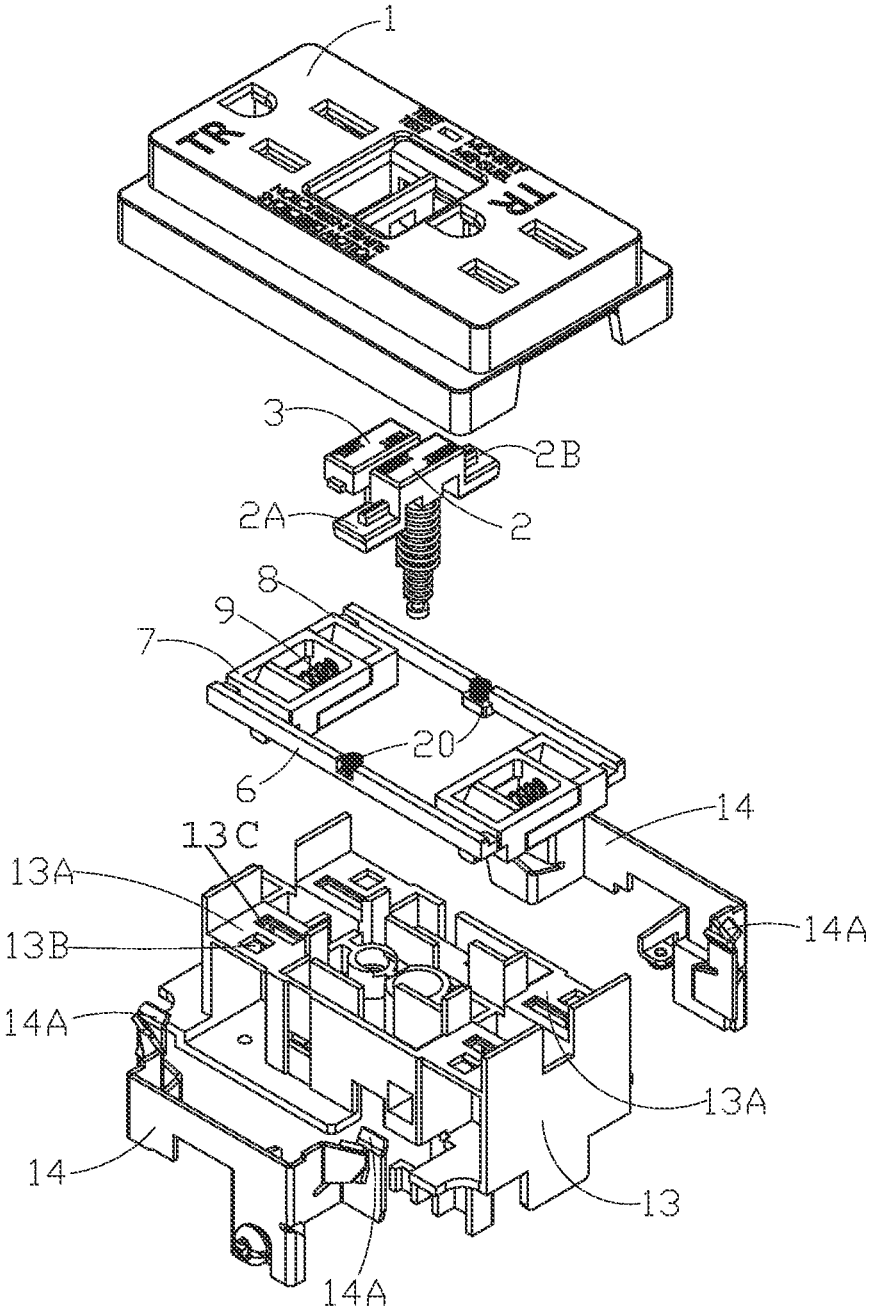
FIG. 1 is a 3-D breakdown structural diagram of Example 1.
Figure 2:
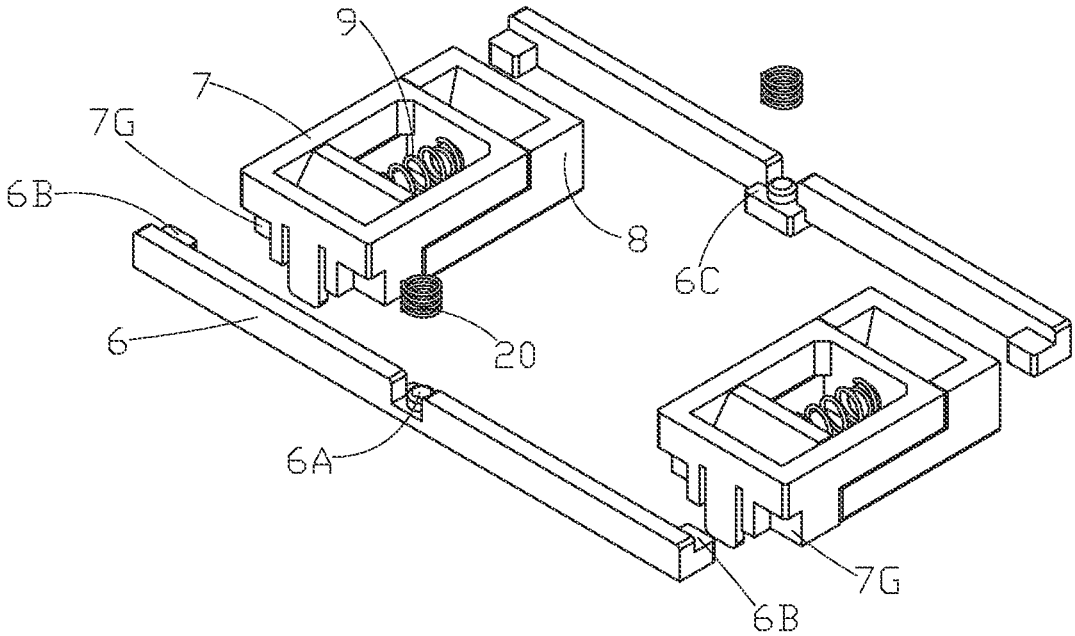
FIG. 2 is a structural diagram of the safety baffle device matching with the baffle latch in Example 1.

With reference to FIGS. 1-7, the example aims at the electrical receptacle with the two sockets both being I-shaped holes. The electrical receptacle with a baffle latching mechanism includes an enclosure (which includes upper cover and pedestal, where only upper cover 1 is shown in FIG. 1), reset button 2 with an extension arm (2A, 2B), and a jack guard baffle mechanism. The jack guard baffle mechanism is provided with a baffle latching mechanism linked with the reset button 2.

The baffle latching mechanism includes baffle latch 6 with positioning convex pin 6B. The outer wall of at least one baffle of the jack guard baffle mechanism has a positioning groove 7G to match with the positioning convex pin. The baffle latching mechanism also includes elastic element 20 which can drive the baffle latch to move up and down. The elastic element 20 mates with the reset button extension arm 2B to allow the baffle to link with the reset button. Specifically, the baffle latch 6 can be provided above or below the reset button extension arm, and the elastic element 20 can be provided above or below the baffle latch 6 accordingly. The elastic element can cooperate with the reset button extension arm to make the baffle latch move up and down.

The possible movement modes are as follows: 1) The reset button extension arms 2A, 2B press baffle latch 6 down. After the reset button extension arms rise, the elastic element 20 pushes the baffle latch up. 2) The reset button extension arms 2A, 2B press the baffle latch 6 down. After the reset button extension arms rise, the elastic element 20 pulls the baffle latch 6 up. 3) After the reset button 2 moves down, the elastic element pushes the baffle latch 6 downwards. While the reset button 2 moves up, the reset button extension arms 2A, 2B lift the baffle latch 6 up. 4) After the reset button 2 moves down, the elastic element 20 pulls the baffle latch 6 downwards. While the reset button 2 rises, the reset button extension arms 2A, 2B lift the baffle latch 6 up. In this example, the baffle latch 6 is located above the reset button extension arms 2A, 2B and the elastic element 20 is located above the baffle latch 6. When the reset button 2 is not reset, elastic element 20 accumulates compression elastic potential energy.

Figure 3:
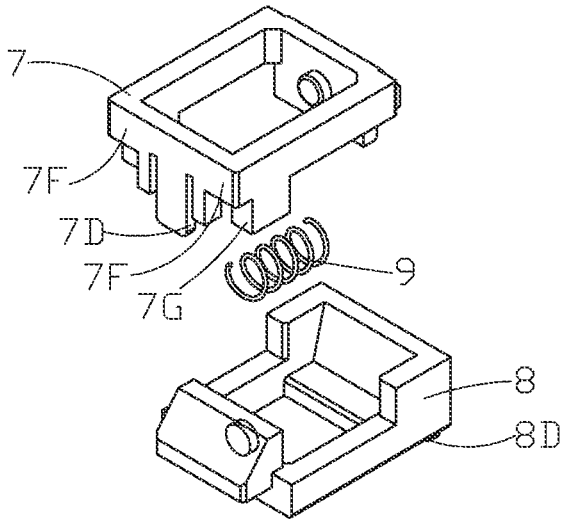
FIG. 3 is a breakdown structural diagram of the safety baffle device of Example 1.

Two groups of sockets are provided on the electrical receptacle of this example. Inside the enclosure, two groups of jack guard baffle mechanisms, shown in FIG. 3, are provided. Latching and unlatching of the two groups of baffle devices can be realized through a baffle latch. The reset button 2 is located between the two groups of jack guard baffle mechanisms. The number of positioning convex pins 6B on the baffle latch 6 and the number of positioning grooves 7G on the baffle 7 or 8 can be multiple. Because unlatching of the baffle 7 or 8 can be realized through cooperation of a positioning convex pin 6B and a positioning groove 7G, each of the two ends of the baffle latch 6 has a positioning convex pin 6B to match with the positioning groove 7G to match with the baffle in the same side as the two groups of jack guard baffle mechanisms.

Elastic element mounting seat with convex pin 6A is provided in the middle of the baffle latch 6. The elastic element 20 of this example is a spring. The two ends of the spring are sustained against the elastic element mounting seat and the top of the enclosure interior (i.e. top of the inner wall of the upper cover 1) respectively. The elastic element can also be an arc reed, V reed, etc. The two ends of the reed can be sustained against a latch. Inside the enclosure, support positions are provided to sustain against the middle of the reed. For example, the middle of the reed can be sustained against the top of the upper interior, or against the middle-level support. The two ends of the reed, facing the middle part sustained against the support position, are bent outwards to realize the up-and-down movement of the baffle latch.

As long as at least one of the left and right baffles 7, 8 is provided with a group of baffle latching mechanisms, the latching of the baffle can be ensured. In this example, both the left baffle 7 and the right baffle 8 are provided with baffle latching mechanisms 6. As long as at least one elastic element 20 is provided, stable resetting in the vertical direction can be ensured. To save material, in this example, only one elastic element and one spring are provided. However, it is also possible to provide multiple ones. The elastic element mounting seat includes a groove located in the middle of the baffle latch 6. Platform 6C is provided at the bottom of the groove. In the center of the platform, there is convex pin 6A. Spring 20 is fixed over the convex pin 6A. Or otherwise, a sleeve, such as a cylindrical indent, can be provided at the center of the platform. The spring 20 is embedded inside the sleeve.

For processing convenience, positioning groove 7G is a rectangular notch located at the two corners on the side of the baffle facing the baffle latch. Above the rectangular notch, there is the latching face 7F which can position along the baffle latch 6. Two positioning grooves 7G are made on one baffle 7 or 8, and so the two groups of jack guard baffle mechanisms are interchangeable and the assembly is convenient.

The jack guard baffle mechanism in this example includes left baffle 7 and right baffle 8 which are made of insulation material, and reset spring 9 used as the baffle elastic reset mechanism. The left and right baffles can match crossly in a sliding way. The left baffle is provided with baffle support foot 7D, and the right baffle is provided with baffle foot 8D.

Inside the enclosure, middle-level support 13 with guide jacks 13C is provided. The middle-level support 13 is equipped with a sliding platform 13A on which the left baffle 7 and right baffle 8 can slide. On the sliding platform, positioning hole 13B is opened for the baffle support feet 7D, 8D to extend in. When the left and right baffles are locked, the two baffle support feet adhere to the inner edges facing the two positioning holes of the middle-level support respectively for positioning. When the left and right baffles are unlocked, the guide jacks in the middle-level support are exposed.

On the middle-level support 13, conductive metal sheet 14 is installed. On the conductive metal sheet, conductive plug bush 14A is provided. The conductive plug bush 14A is located below the guide jack 13C of the middle-level support 13. When the baffles are opened, a plug will insert into the conductive plug bush 14A.

Figure 4:
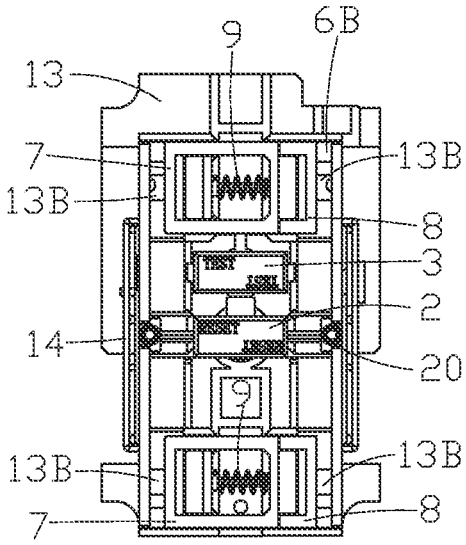
FIG. 4 is a vertical-view structural diagram of Example 1 with the baffle in a latched state (upper cover removed).
Figure 5:
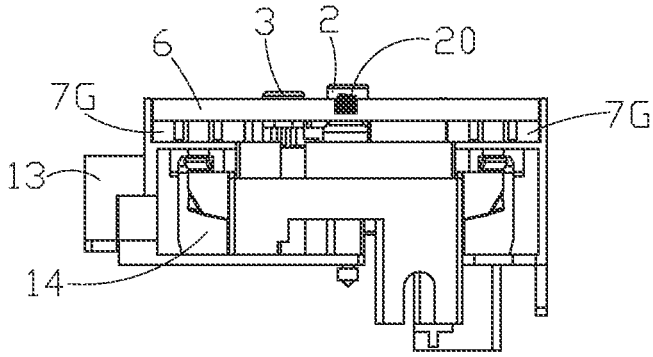
FIG. 5 is a side structural diagram of Example 1 with the baffle in a latched state (upper cover removed).

The action process is as follows: In an initial state, the reset button 2 is not pressed down, the positioning convex pins 6B contact with the latching face 7F above the baffle latch positioning groove 7G. The left baffle 7 is latched, and the spring 20 is compressed to accumulate compression elastic potential energy. Refer to FIGS. 4 & 5. Because the positioning convex pin 6B contacts the latching face 7F, the baffles 7 and 8 cannot slide open to allow a plug or other object to enter. This ensures the safety of a user because any condition such as reverse wiring, electrical fault, or end of device life can cause the reset button to rise up, thereby adjusting the baffle latch 6 to the latched position. This arrangement also allows a receptacle to be shipped in a latched condition so that if reverse wiring occurs, the user is deterred from using the receptacle.

Figure 6:
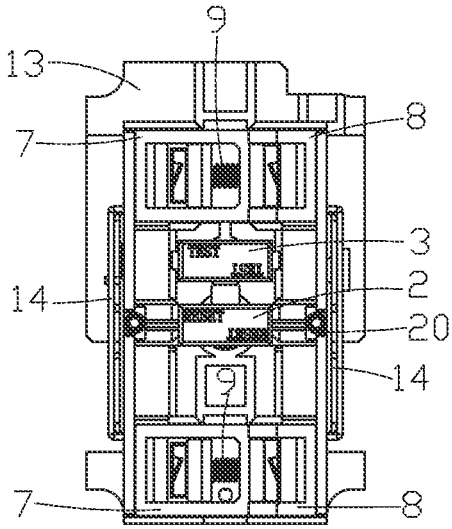
FIG. 6 is a vertical-view structural diagram of Example 1 with the baffle in an unlatched state (upper cover removed).
Figure 7:
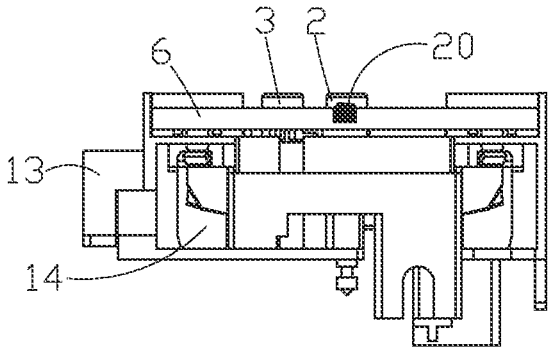
FIG. 7 is a side structural diagram of Example 1 with the baffle in an unlatched state (upper cover removed).
Figure 8:
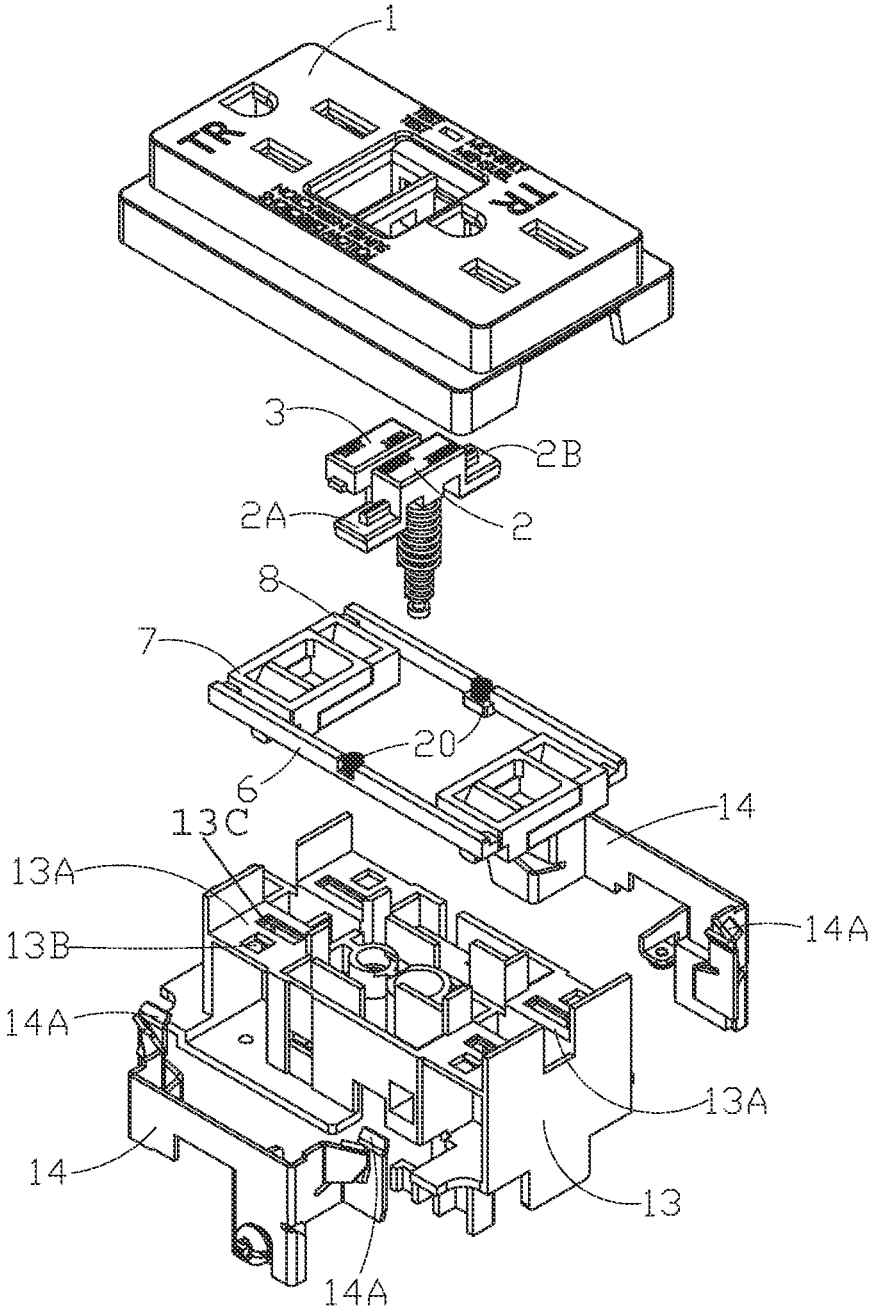
FIG. 8 is a 3-D breakdown structural diagram of Example 2.
Figure 9:
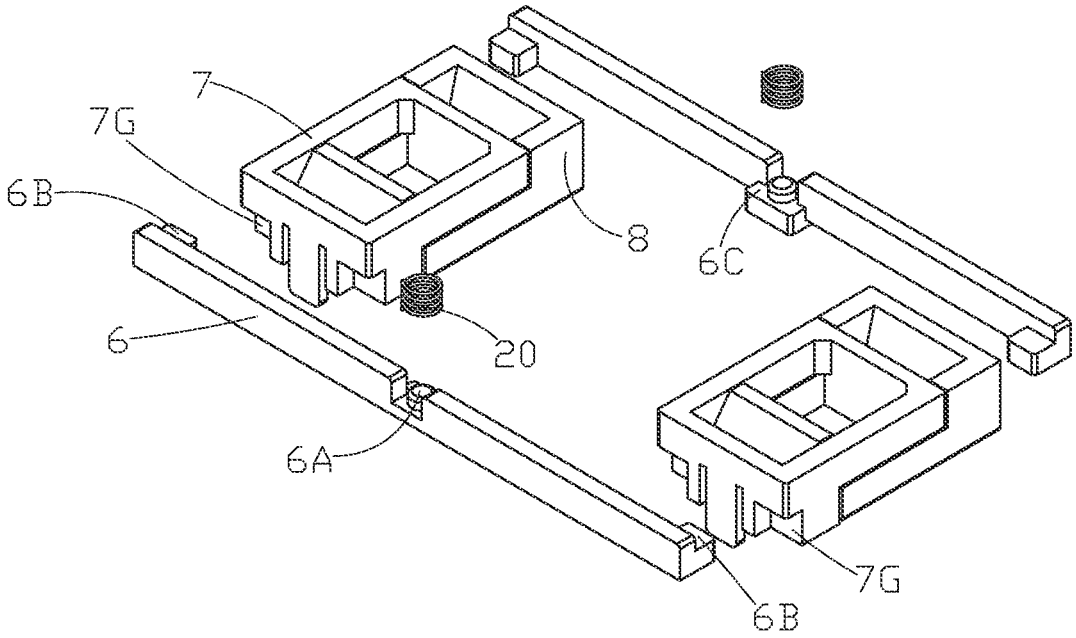
FIG. 9 is a structural diagram of the safety baffle device matching with the baffle latch in Example 2.
Figure 10:
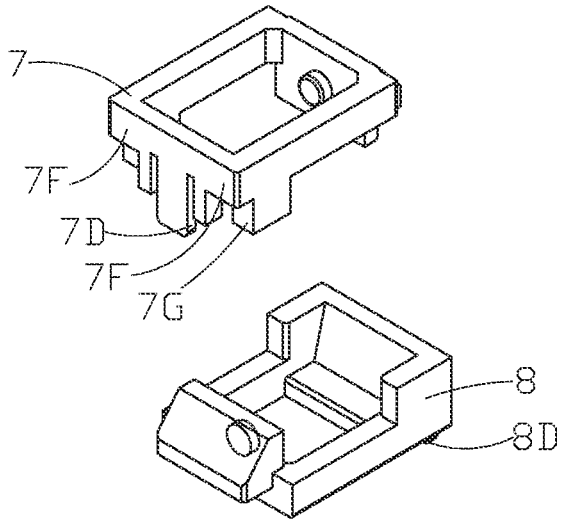
FIG. 10 is a breakdown structural diagram of the safety baffle device of Example 2.
Figure 11:
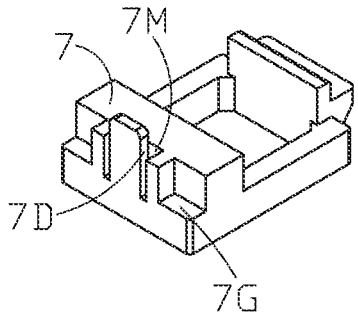
FIG. 11 is a structural diagram with the left baffle in FIG. 10 turned over.
Figure 12:
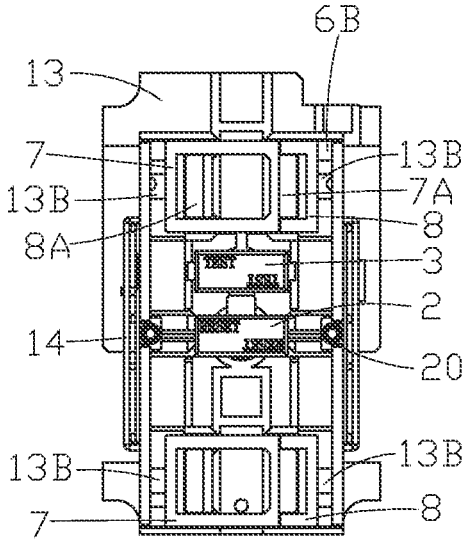
FIG. 12 is a vertical-view structural diagram of Example 2 with the baffle in a latched state (upper cover removed).
Figure 13:
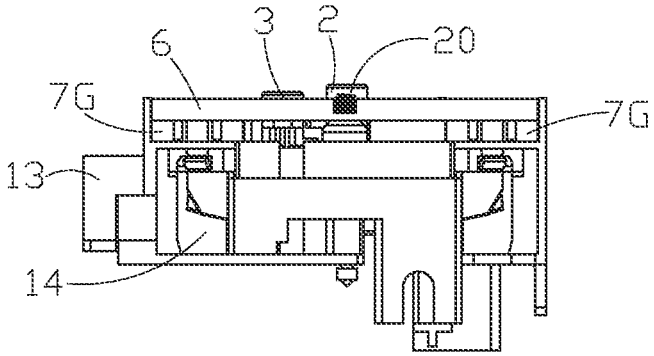
FIG. 13 is a side structural diagram of Example 2 with the baffle in a latched state (upper cover removed).
Figure 14:
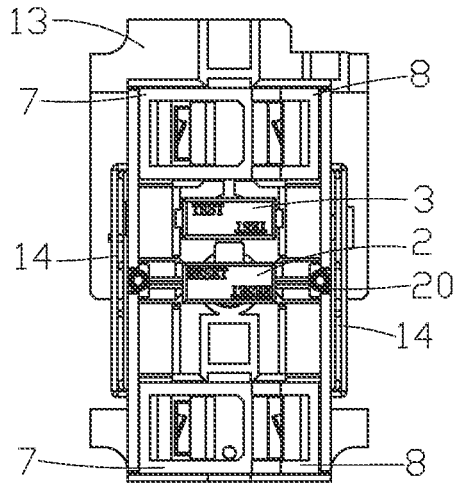
FIG. 14 is a vertical-view structural diagram of Example 2 with the baffle in an unlatched state (upper cover removed).
Figure 15:
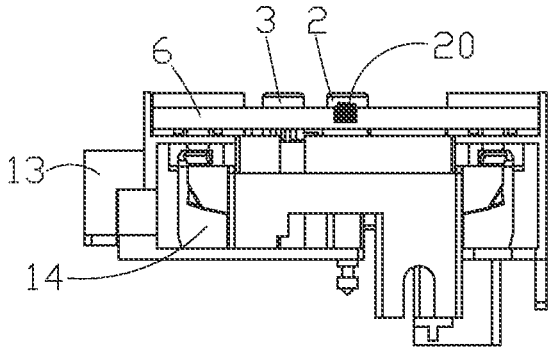
FIG. 15 is a side structural diagram of Example 2 with the baffle in an unlatched state (upper cover removed).
Figure 16:
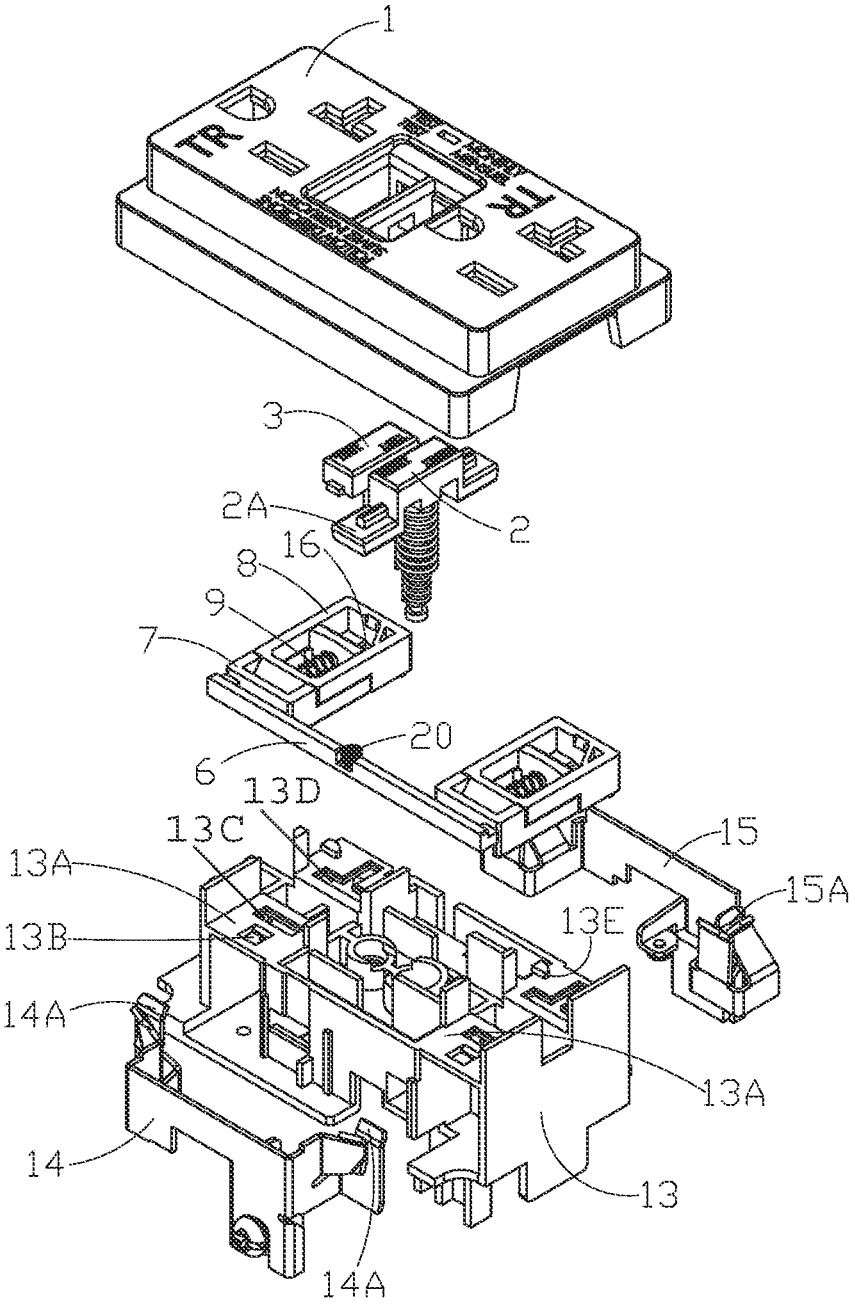
FIG. 16 is a 3-D breakdown structural diagram of Example 3.
Figure 17:
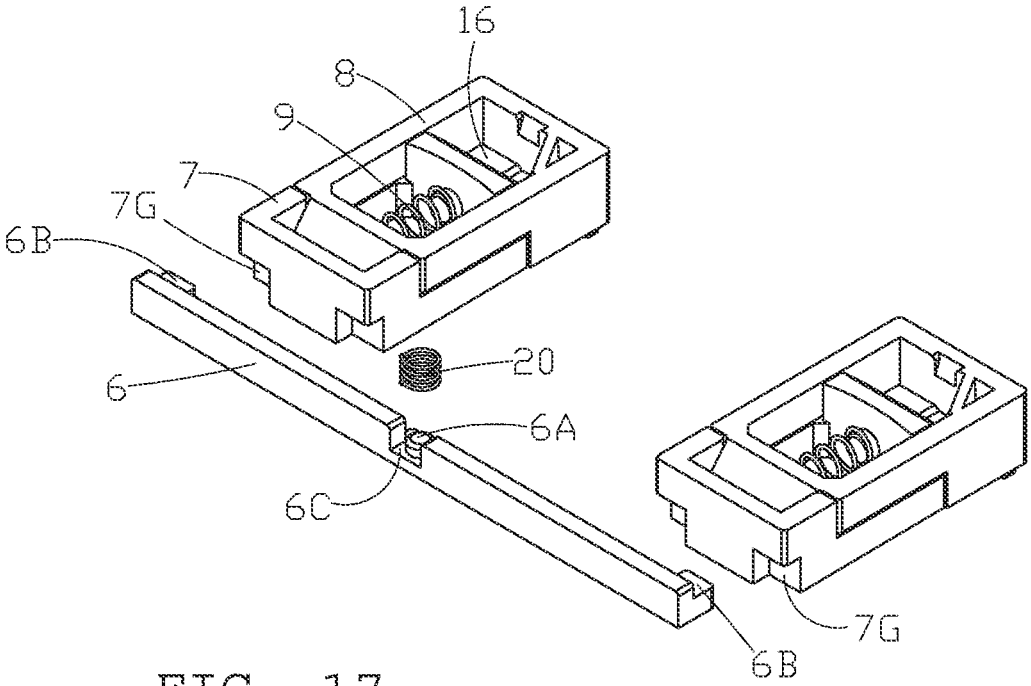
FIG. 17 is a structural diagram of the safety baffle device matching with the baffle latch in Example 3.
Figure 18:
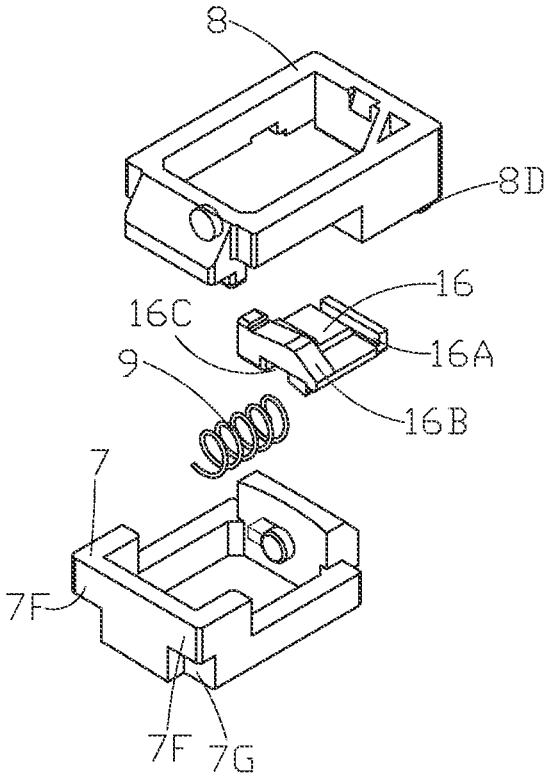
FIG. 18 is a breakdown structural diagram of the safety baffle device of Example 3.
Figure 19:
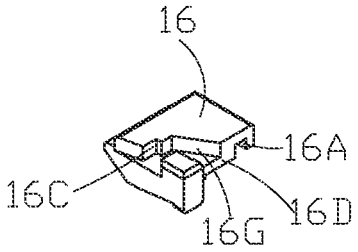
FIG. 19 is a structural diagram with the small baffle in FIG. 18 turned over.
Figure 20:
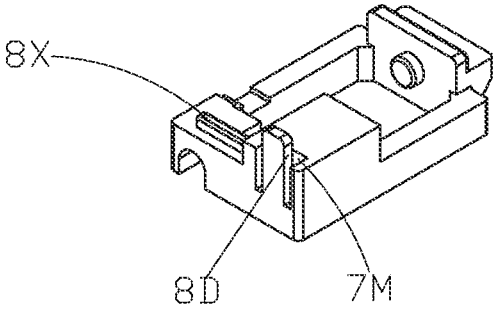
FIG. 20 is a structural diagram with the right baffle in FIG. 18 turned over.

When the reset button 2 is pressed down and is in reset status, the reset button extension arms 2A, 2B go downwards, the baffle latch 6 moves downwards under the action of spring 20 to move the positioning convex pins 6B to the position corresponding to the positioning grooves 7G. The left baffle 7 is allowed to open. The action process of the baffle latch of the right baffle 8 is identical to that of the baffle latch of the left baffle, and occurs simultaneously. In this time, when an electric plug is inserted in, the left and right baffles will be opened, as shown in FIGS. 6 & 7.

With reference to FIGS. 8~15, this example is different from Example 1 in that: In this example, the reset is realized through the elastic support feet provided on the baffle 6. Specifically, the baffle elastic reset mechanism is elastic support feet (7D & 8D) provided on the left and right baffles respectively.

Inside the enclosure, middle-level support 13 with a guide jack is provided. On the sliding platform 13A of the middle-level support 13, positioning hole 13B is provided for the elastic support feet (7D & 8D) to extend in. When the left and right baffles are locked, the two elastic support feet (7D & 8D) of the two baffles adhere to the outer edges facing the two positioning holes 13B of the middle-level support respectively for positioning. When the left and right baffles are unlocked, the elastic support feet (7D & 8D) accumulate elastic potential energy for opposite movement, and the guide jacks in the middle-level support are exposed. The elastic support feet (7D & 8D) on the said left and right baffles are located on the outer wall of the corresponding baffles respectively. At the connection between the elastic support foot 7D and the bottom of the left baffle 7, groove 7M is made to provide the elastic support foot 7D with bending space. Corresponding groove is also made on the right baffle 8. Similarly to Example 1, as long as one of the left baffle 7 and the right baffle 8 is provided with a group of baffle latching mechanisms, latching of the baffle can be ensured. In this example, both the left baffle 7 and the right baffle 8 are provided with baffle latching mechanisms. The action process is similar to that of Example 1 but includes the above elastic compression of the elastic support feet.

With reference to FIGS. 16-24, this example aims at the electrical receptacle with I-shaped jacks in the left side and with T-shaped jacks in the right side. Inside the enclosure, middle-level support 13, conductive metal sheet 14 and conductive metal sheet 15 are provided. The conductive metal sheet 14 is provided with I-shaped conductive plug bushes 14A, while the conductive metal sheet 15 is provided with T-shaped conductive plug bushes 15A. On the middle-level support 13, guide jacks 13C, 13D are made corresponding to the positions of I-shaped conductive plug bush 14A and T-shaped conductive plug bush 15A. When the guide jacks are exposed, the conductive plug bushes can also be exposed. In this example, the jack guard baffle mechanism includes left baffle 7, right baffle 8 and small baffle 16. The small baffle 16 is located below the right baffle 8. The left baffle 7 is provided with a group of baffle latching mechanisms.

The jack guard baffle mechanism includes left baffle 7, right baffle 8 and reset spring 9. The left and right baffles can match crossly in a sliding way. The right baffle 8 is provided with baffle support foot 8D. For the left baffle 7, due to the limitation of the baffle latch, it is not necessary to provide a baffle support foot. Below the right baffle 8, small baffle 16 is provided. Guide rail 8X is provided below the right baffle 8. The small baffle 16 has guide groove 16A to cooperate with the guide rail 8X of the right baffle. Above the small baffle 16, there is a travel slant 16B which allows the small baffle 6 to move along the direction perpendicular to the right baffle opening direction under the action of the T-shaped plug. Sliding platform 13B for baffle sliding is provided on the middle-level support 13. The small baffle 16 is provided between the right baffle 8 and the sliding platform 13B of the middle-level support 13.

With the small baffle, it is not necessary to provide a baffle latch 6 at the external side of the right baffle. As such, the baffle latch 6 at that location is optional. A baffle latching mechanism is provided at the external side of the said left baffle. Shown in broken lines in FIG. 18, locking block is provided at the front end of the left baffle 7.

Locking groove 16C is provided in the left side of the small baffle 16 to match with the locking block of the left baffle. Positioning wedge 13E is provided on the middle-level support 13. Below the small baffle 16, latching face 16D to match with the front end of the positioning wedge 13E of the middle-level support, and the second guide groove 16G to match with the slant side of the positioning wedge are provided. After the plug is inserted in, the various groups of wedging mechanisms cooperating with each other are separated and unlatched automatically. After the plug is pulled out, they fit and latch automatically with the assistance of the spring or elastic component pressures and the interaction of the various wedges and sliding faces.

Figure 21:
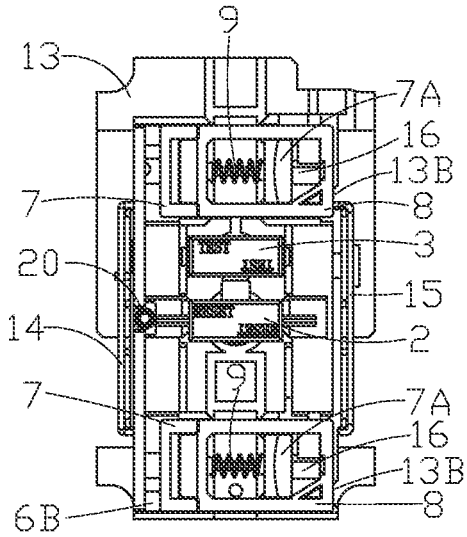
FIG. 21 is a vertical-view structural diagram of Example 3 with the baffle in a latched state (upper cover removed).
Figure 22:
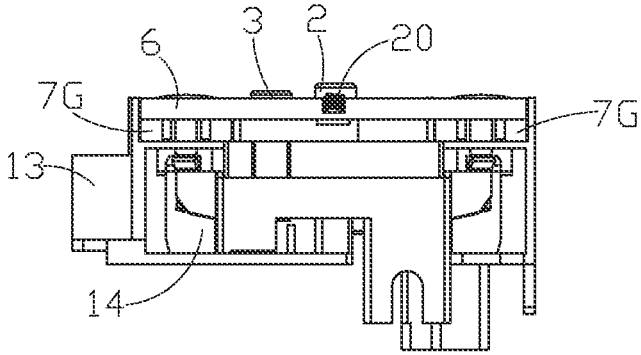
FIG. 22 is a side structural diagram of Example 3 with the baffle in a latched state (upper cover removed).
Figure 23:
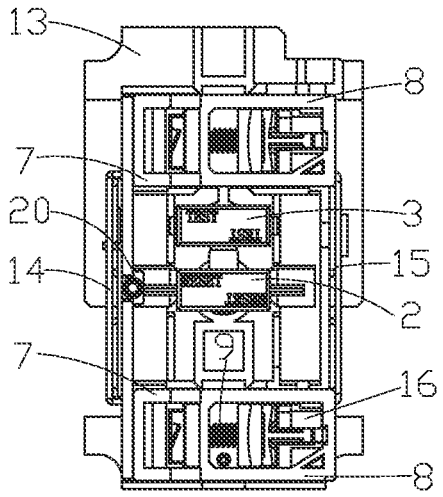
FIG. 23 is a vertical-view structural diagram of Example 3 with the baffle in an unlatched state (upper cover removed).
Figure 24:
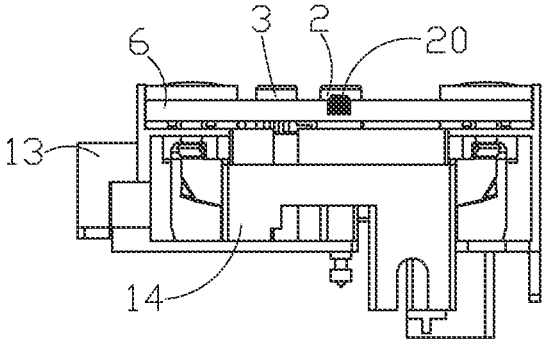
FIG. 24 is a side structural diagram of Embodiment 3 with the baffle in an unlatched state (upper cover removed).

The action process is as follows: In an initial state, the reset button 2 is not pressed down, the baffle latch positioning convex pin 6B contacts with the latching face 7F in the external side of the left baffle 7, and the left baffle 7 is latched, as shown in FIGS. 21 & 22. When the reset button 2 is pressed down and is reset successfully, the reset button extension arms 2A, 2B move downwards, the baffle latch 6 moves downwards under the action of the elastic element until the positioning convex pin 6B corresponds to the baffle positioning groove 7G. When a plug is inserted in, the baffles can be opened, exposing the guide jacks and conductive plug bushes on the middle-level support 13. Refer to FIGS. 23 & 24.

In the preceding specification, various preferred embodiments have been described with reference to the accompanying drawings. It will, however, be evident that various other modifications and changes may be made thereto, and additional embodiments may be implemented, without departing from the broader scope of the invention as set forth in the claims that follow. The specification and drawings are accordingly to be regarded in an illustrative rather than restrictive sense.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

I claim:

1. A baffle latching mechanism for an electrical receptacle, comprising:

a rectilinear baffle latch comprising:

a first side perpendicular to a second side;

a positioning groove between a first end and a second end of the first side;

a platform at the bottom of the positioning groove; and a positioning convex pin projecting from the second side of the baffle latch.

2. The baffle latching mechanism of claim 1, wherein the platform comprises one of a spring positioning convex pin or a spring positioning sleeve.

3. The baffle latching mechanism of claim 1, further comprising one of a coil spring, an arc reed, or a v reed in contact with the platform.

4. A safety mechanism for an electrical receptacle, comprising:

a rectilinear baffle latch comprising:

a first side perpendicular to a second side;

a positioning groove between a first end and a second end of the first side;

a platform at the bottom of the positioning groove; and a positioning convex pin projecting from the second side of the baffle latch, and a baffle comprising an end face and a groove in the end face, wherein the positioning convex pin projects against the end face of the baffle when the baffle latching mechanism is in a locked condition, and wherein the positioning convex pin projects in to the groove of the baffle when the baffle latching mechanism is in an unlocked condition.

5. The safety mechanism of claim 4, further comprising one of a coil spring, an arc reed, or a v reed in contact with the platform for pressing against a surface in the electrical receptacle.

6. The safety mechanism of claim 4, further comprising one of a coil spring, an arc reed, or a v reed in contact with the platform for pressing against a reset button extension arm in the electrical receptacle.

7. An electrical receptacle comprising:

a reset button;

a reset extension arm attached to the reset button;

an enclosure;

a baffle comprising an outer wall and a positioning groove in the outer wall, a baffle latch comprising:

a positioning convex pin; and an elastic element, wherein:

the elastic element abuts the baffle latch and one of the enclosure or the reset extension arm, and the elastic element drives the baffle latch between a locked condition and an unlocked condition, the reset button is configured to move between a tripped position and a reset position, when the reset button is in the tripped position, the positioning convex pin projects against the outer wall of the baffle and the baffle latch is in the locked condition, and when the reset button is in the reset position, the positioning convex pin projects in to the groove of the baffle and the baffle latch is in the unlocked condition.

8. The electrical receptacle of claim 7, wherein:

the baffle latch is located below the reset button extension arm, the elastic element is located below the baffle latch, and when the reset button resets, the elastic element accumulates compression elastic potential energy.

9. The electrical receptacle of claim 7, wherein:

the baffle latch is located above the reset button extension arm, the elastic element is located above the baffle latch, and when the reset button does not reset, the elastic element accumulates compression elastic potential energy.

10. The electrical receptacle of claim 7, further comprising:

a second baffle comprising a second outer wall and a second positioning groove in the second outer wall;

an elastic element mounting seat between two ends of the baffle latch; and a second positioning convex pin, wherein:

the reset button is between the baffle and the second baffle, the positioning convex pin is at a first of the two ends, and the second positioning convex pin is at a second of the two ends and is configured to selectively project into the second positioning groove.

11. The electrical receptacle of claim 9, wherein the elastic element is one of an arc reed or a V reed having two ends sustained on the baffle latch and a middle portion sustained against a position inside the enclosure.

12. The electrical receptacle of claim 9, further comprising an elastic element mounting seat between two ends of the baffle latch, wherein the elastic element is a coil spring having two ends, a first of the two coil spring ends is sustained against the elastic element mounting seat and a second of the two coil spring ends is sustained against the enclosure.

13. The electrical receptacle of claim 12, wherein the elastic element mounting seat comprises:

a groove;

a platform at the bottom of the groove; and one of a convex pin or a hollow sleeve at a center of the platform, wherein the spring is fixed on the convex pin or is embedded in the sleeve.

14. The electrical receptacle of claim 7, wherein the positioning groove is a rectangular notch and the end face is above the rectangular notch.

15. The electrical receptacle of claim 7 wherein the baffle latch comprises a second positioning convex pin and the baffle comprises a second positioning groove in the outer wall, and wherein the second positioning convex pin is configured to selectively project in to the second positioning groove.

16. The electrical receptacle of claim 7, further comprising:
a middle-level support inside the enclosure, the mid-level support comprising:
guide jacks; and
a sliding platform;
wherein:
the baffle is configured to slide on the sliding platform and the baffle further comprises:
a left baffle and a right baffle, overlapped; and
an elastic reset mechanism between the left baffle and the right baffle configured to push the left baffle and the right baffle together to block the guide jacks, and
the left and right baffle are made of insulation material.

17. The electrical receptacle of claim 16, wherein:
the elastic reset mechanism comprises a spring;
the left baffle comprises a left baffle support foot and the right baffle comprises a right baffle support foot,
the sliding platform further comprises positioning holes configured to accept the left baffle support foot and the right baffle support foot,
when the baffle latch is in the locked condition, the left baffle support foot and the right baffle support foot press against innermost edges of their respective positioning holes, and
when the baffle latch is in the unlocked condition, the left baffle and the right baffle are configured to slide to expose the guide jacks.

18. The electrical receptacle of claim 16, wherein:
the elastic reset mechanism comprises an elastic left baffle support foot extending from the left baffle and an elastic right baffle support foot extending from the right baffle,
the sliding platform further comprises positioning holes configured to accept the elastic left baffle support foot and the elastic right baffle support foot,
when the baffle latch is in the locked condition, the elastic left baffle support foot and the elastic right baffle support foot press against outermost edges of their respective positioning holes, and
when the baffle latch is in the unlocked condition, the left baffle and the right baffle are configured to slide to expose the guide jacks, and the elastic left baffle support foot and the elastic right baffle support foot are configured to accumulate elastic potential energy.

19. The electrical receptacle of claim 18, wherein:
the baffle comprises a second outer wall,
the elastic left baffle support foot is located on the outer wall and the elastic right baffle support foot is located on the second outer wall,
the left baffle further comprises a left baffle groove between a left baffle bottom and the elastic left baffle foot, and
the right baffle further comprises a right baffle groove between a right baffle bottom and the elastic right baffle foot.

20. The electrical receptacle of claim 16, wherein the baffle latch abuts the left baffle and a second baffle latch abuts the right baffle, and wherein baffle is in between the baffle latch and the second baffle latch.

21. The electrical receptacle of claim 7, further comprising:
a middle-level support with guide jacks;
a jack guard baffle mechanism comprising a left baffle, right baffle and a small baffle;
a first guide groove;
a second guide groove;
a guide rail;
a locking block;
a locking groove;
a positioning wedge;
a latching face; and
a travel slant,
wherein:
a right guide jack of the middle-level support is T-shaped,
the left baffle and right baffle overlap in a sliding way,
the guide rail is provided below the right baffle,
the small baffle includes the first guide groove to match with the guide rail of the right baffle,
above the small baffle, the travel slant is configured to back the small baffle off along a direction perpendicular to a right baffle opening direction when the right baffle is under the action of a T-shaped plug,
the locking block is provided at the front end of the left baffle,
the locking groove is provided in the left side of the small baffle to match with the locking block of the left baffle,
the positioning wedge is provided on the middle-level support, below the small baffle, the latching face is provided to match with the front end of the positioning wedge of the middle-level support, and
the second guide groove is provided to match with the slant side of the positioning wedge.

22. The electrical receptacle of claim 21, wherein the baffle latch abuts the left baffle.

23. The electrical receptacle of claim of claim 22, wherein at least one of the left baffle and the right baffle comprise an elastic support foot.

* * * * *